US010140927B2

(12) United States Patent
Kuo et al.

(10) Patent No.: US 10,140,927 B2
(45) Date of Patent: Nov. 27, 2018

(54) GRAY SCALE GENERATOR AND DRIVING CIRCUIT USING THE SAME

(71) Applicant: MY-SEMI INC., Hsinchu County (TW)

(72) Inventors: Chun-Ting Kuo, Hsinchu County (TW); Cheng-Han Hsieh, Hsinchu County (TW)

(73) Assignee: MY-SEMI INC., Hsinchu County (TW)

( * ) Notice: Subject to any disclaimer, the term of this patent is extended or adjusted under 35 U.S.C. 154(b) by 0 days.

(21) Appl. No.: 15/683,758

(22) Filed: Aug. 22, 2017

(65) Prior Publication Data

US 2018/0268761 A1 Sep. 20, 2018

(30) Foreign Application Priority Data

Mar. 15, 2017 (TW) ..... 106108540 A

(51) Int. Cl.

| | |
|---|---|
| ***G09G 3/36*** | (2006.01) |
| ***G09G 3/3275*** | (2016.01) |
| ***G09G 3/3241*** | (2016.01) |
| ***G09G 3/34*** | (2006.01) |

(52) U.S. Cl.

CPC ..... *G09G 3/3275* (2013.01); *G09G 3/3241* (2013.01); *G09G 3/34* (2013.01); *G09G 2310/027* (2013.01)

(58) Field of Classification Search

CPC ..... G09G 3/3677; G09G 5/003; G09G 2310/0286; G09G 2310/08; G09G 2330/021; G09G 3/20; G09G 3/36; G09G 2310/0291; G11C 19/287; G11C 19/28

See application file for complete search history.

(56) References Cited

U.S. PATENT DOCUMENTS

2005/0156635 A1* 7/2005 Yoneyama ..... G09G 3/32 327/108

2016/0189605 A1* 6/2016 Ahn ..... G09G 3/3225 345/213

* cited by examiner

*Primary Examiner* — Nelson Rosario

(74) *Attorney, Agent, or Firm* — Li & Cai Intellectual Property (USA) Office

(57) ABSTRACT

A driving circuit for driving a light emitting unit includes a gray scale generation circuit and a driving unit, and a gray scale generation circuit, includes a shift register unit and a data storage unit. The shift register unit receives a luminance-related data, and the shift register unit is a k-bit shift register unit. The data storage unit has parallel input ends and a serial output end. The data storage unit receives the luminance-related data via its parallel input ends and serially outputs bits of the luminance-related data to generate a serial signal. The data storage unit determines time points to output different bits of the serial signal to generate a gray-scale control signal according to a serial-out control signal. The driving unit is coupled to the gray scale generation circuit to adjust a light-emitting time of the light emitting unit according to the gray-scale control signal.

15 Claims, 9 Drawing Sheets

GRAY SCALE GENERATOR AND DRIVING CIRCUIT USING THE SAME

BACKGROUND OF THE INVENTION

1. Field of the Invention

The present disclosure relates to a gray scale generation circuit and a driving circuit using the same; in particular, to a gray scale generation circuit and a driving circuit using the same which can support high bit data but will not raise the circuit cost.

2. Description of Related Art

Generally, the gray-scale generation of a light-emitting unit, such as a light emitting diode, can be achieved by adjusting the ratio of the light-emitting time and the time for emitting light. The reciprocal of the frame rate is the frame period. For example, if the frame rate is 60 Hz, the frame period is 1/60s. Ideally, the entire frame period can be the time for emitting light; however, considering certain scanning applications, ghost cancellation, or other circuit factors, part of the frame period is not for emitting light. Thus, the frame period equals the time not for emitting light plus the time for emitting light.

The gray-scale generation can be achieved by adjusting the percentage of the light-emitting time in the time for emitting light. For a common displayer, n-bit gray scale indicates that the time for emitting light in a frame period is divided into $2^n$ or $2^{n-1}$ gray-scale units, wherein the time length of one gray-scale unit is defined as one time unit "t". In other words, the time length of one gray-scale unit equals the time for emitting light in a frame period divided by $2^n$ or $2^{n-1}$. Then, the luminance of the light emitting unit can be determined by determining the number of time units in the time for emitting light of a frame period according to the n-bit gray-scale data (represented by D[n−1:0]).

Referring to FIG. 1, a block diagram of a traditional gray scale generation circuit is shown. As shown in FIG. 1, a conventional gray scale generation circuit includes an n-bit shift register unit 12, an n-bit PIPO (Parallel Input Parallel Out; PIPO) data storage unit 14, an n-bit digital comparator 16 and an n-bit gray-scale counter 18, wherein n is an integer greater than 1. The working mechanism of this conventional gray scale generation circuit is as follows. First, an input data signal DI with an n-bit gray-scale data is sequentially inputted to the n-bit shift register unit 12. This data transmission is generally with a data clock signal DCK. After that, all bits of the n-bit gray-scale data in the n-bit shift register unit 12 are read by the PIPO data storage unit 14 at the same time according to a latch signal LAT. Then, all bits of the n-bit gray-scale data in the PIPO data storage unit 14 are simultaneously outputted to the n-bit digital comparator 16. The n-bit digital comparator 16 compares the received gray-scale data with a counting number generated by the n-bit gray-scale counter 18, and accordingly generates a gray-scale control signal GSC for a driving circuit to determine whether to drive the light emitting unit. When the gray-scale data is larger than the counting number generated by the n-bit gray-scale counter 18, the driving circuit drives the light emitting unit, and vice versa. As shown in FIG. 1, the n-bit gray-scale counter 18 counts by using a gray-scale clock signal GCK.

When n=5, the gray-scale data is represented as D[4:0]. In this case, the time for emitting time in a frame period is consisted of $2^n$ gray-scale units (or $2^n$ pulses of the gray-scale clock signal GCK), wherein the time length of each gray-scale unit is one time unit "t". When the gray-scale data is larger than the counting number generated by the n-bit gray-scale counter 18, the n-bit digital comparator 16 outputs the gray-scale control signal GSC to drive the light emitting unit. If D[4:0]=00001, the light emitting unit is driven to emit light for one time unit and the luminance of the light emitting unit is 1/32. Likewise, D[4:0]=00010, the light emitting unit is driven to emit light for two time units and the luminance of the light emitting unit is 2/32.

Currently, when light emitting unit is used in a display, the gray scale generation circuit and the driving circuit using the same are required to be able to support high bit data. The time length of each gray-scale unit is required to be as short as possible. In other words, the frequency of the gray-scale clock signal GCK is required to be higher. However, the frequency of the gray-scale clock signal GCK is restricted by the operating time of the gray-scale counter 18 and the n-bit digital comparator 16. If the gray scale generation circuit must support high bit data, the circuit cost will definitely be raised.

SUMMARY OF THE INVENTION

The present disclosure provides a gray scale generation circuit. The gray scale generation circuit is used in a driving circuit of a light emitting unit, and includes a shift register unit and a PISO (Parallel Input Serial Output; PISO) data storage unit. The shift register unit receives a luminance-related data, wherein the luminance-related data is relevant to a gray-scale data. The luminance of the light emitting unit is determining by the gray-scale data, and the gray-scale data has n bits and n is a positive integer greater than 1. The luminance-related data has k bits, and k is a positive integer greater than 1. The k-bit luminance-related data can be the entire gray-scale data or can be part of the gray-scale data. The PISO data storage unit is coupled to the shift register unit. The luminance-related data in the shift register unit is transmitted to the PISO data storage unit according to a latch signal. The PISO data storage unit outputs different bits of the luminance-related data at different time points such that the gray scale generation circuit generates a gray-scale control signal. The driving circuit drives the light emitting unit according to the gray-scale control signal.

In one embodiment of the gray scale generation circuit provided by the present disclosure, different bits of the luminance-related data correspond to different numbers of time units, and the driving circuit generates the gray-scale control signal according to different bits of the luminance-related data and their corresponding numbers of time units. In this manner, the driving circuit can determine the light-emitting time of the light emitting unit according to different bits of the luminance-related data and their corresponding numbers of time units. In another embodiment, different bits of the luminance-related data can correspond to the same number of time units.

In one embodiment of the gray scale generation circuit provided by the present disclosure, the PISO data storage unit is a PISO shift register.

For a conventional gray scale generation circuit, whether to generate a gray-scale control signal to drive a light emitting unit is determined by comparing a gray-scale data in a PIPO data storage unit and a counting number generated by a gray-scale counter. However, the frequency of the gray-scale clock signal of the gray-scale counter is restricted by the operating time of the gray-scale counter and the n-bit digital comparator. Thus, it is hard to increase the frequency of the gray-scale clock signal. In other words, it is difficult to divide the time for emitting light in a frame period into more time units.

Differently, in the gray scale generation circuit of the present disclosure, by using a PISO data storage unit, all bits of a luminance-related data are inputted at the same time and different bits of the luminance-related data are outputted at different time points to generate the required gray scale/the required luminance. Thus, by using the present disclosure, it is easy to divide the time for emitting light in a frame period into more time units. Moreover, in the present disclosure, the PISO data storage unit is used to replace the data storage unit, the gray-scale counter and the digital comparator needed by the conventional gray scale generation circuit. Therefore, the circuit cost can be effectively reduced.

For further understanding of the present disclosure, reference is made to the following detailed description illustrating the embodiments of the present disclosure. The description is only for illustrating the present disclosure, not for limiting the scope of the claim.

BRIEF DESCRIPTION OF THE DRAWINGS

Embodiments are illustrated by way of example and not by way of limitation in the figures of the accompanying drawings, in which like references indicate similar elements and in which.

DETAILED DESCRIPTION OF EXEMPLARY EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings. In these drawings, like references indicate similar elements.

Figure 1:
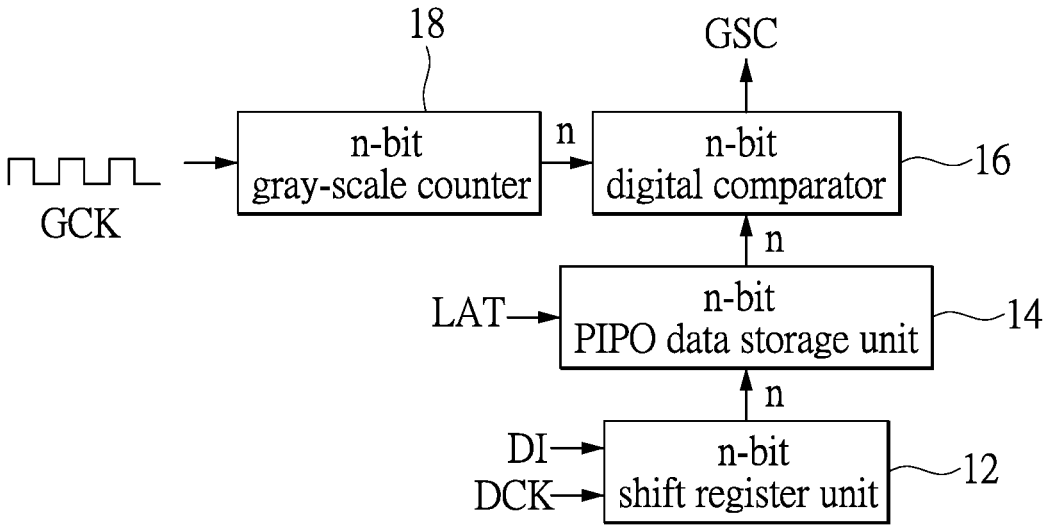
FIG. 1 PRIOR ART
FIG. 1 shows a block diagram of a traditional gray scale generation circuit.
Figure 2:
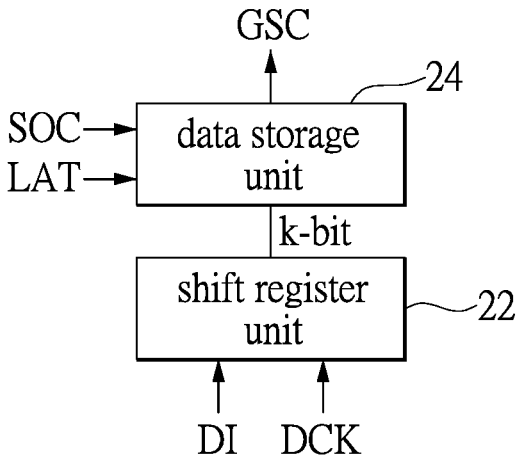
FIG. 2 shows a block diagram of a gray scale generation circuit of one embodiment of the present disclosure.

Referring to FIG. 2, a block diagram of a gray scale generation circuit of one embodiment of the present disclosure is shown. The gray scale generation circuit can be configured in a driving circuit of a light emitting unit to provide a gray-scale control signal GSC to the driving circuit. Then, the driving circuit determines the light-emitting time of the light emitting unit according to the gray-scale control signal GSC. In other words, the driving circuit determines the luminance of the light generated by the light emitting unit according to the gray-scale control signal GSC.

As shown in FIG. 2, the gray scale generation circuit provided by this embodiment mainly includes a shift register unit 22 and a data storage unit 24. The data storage unit 24 is coupled to the shift register unit 22. The shift register unit 22 receives and temporarily stores a luminance-related data. The data storage unit 24 reads and stores the luminance-related data in the shift register unit 22 according to a latch signal LAT. According to a serial-out control signal SOC, the data storage unit 24 outputs different bits of the luminance-related data at different time points to generate the gray-scale control signal GSC. Then, the driving circuit of the light emitting unit determines the light-emitting time of the light emitting unit according to the gray-scale control signal GSC. It is worth mentioning that, the data storage unit 24 is a PISO data storage unit. For example, the data storage unit 24 can be a PISO shift register. Generally, the PISO shift register includes flip-flops and multiplexers, or includes flip-flops having the reset function, but the circuit configuration of the data storage unit 24 is not limited thereto. Details about how the PISO data storage unit works are illustrated in the following description.

It should be noted that, the luminance-related data is a k-bit luminance-related data, and k is a positive integer greater than 1. The feature of the gray scale generation circuit provided by this embodiment is that, each bit of the luminance-related data corresponds to a specific number of time units. The k bits of the luminance-related data are simultaneously read and stored by the data storage unit 24 from the shift register unit 22. Then, the data storage unit 24 outputs the k-bit luminance-related data by outputting one bit at different time points to generate the gray-scale control signal GSC. Since different bits of the luminance-related data are outputted at different time points, and different bits of the luminance-related data corresponds to different numbers of time units, the driving circuit can determine the light-emitting time of the light emitting unit (which is the luminance or the gray scale) according to each bit of the luminance-related data and its corresponding numbers of time units.

The major difference between a conventional gray scale generation circuit and the gray scale generation circuit provided by this embodiment is that, a PIPO (Parallel In Parallel Out; PIPO) data storage unit, a gray-scale counter and a digital comparator in the conventional gray scale generation circuit are replaced by the data storage unit 24 in the gray scale generation circuit provided by this embodiment, which is a PISO data storage unit. After simultaneously reading each bit of the luminance-related data, the data storage unit 24 outputs only one bit of the luminance-related data at different time points such that the driving circuit can determine the light-emitting time of the light emitting unit according to each bit and its corresponding number of time units.

There are several embodiments described in the following description for illustrating the gray scale generation circuit of the present disclosure, but the present disclosure is not limited thereto.

One Embodiment of the Gray Scale Generation Circuit

Figure 3A:
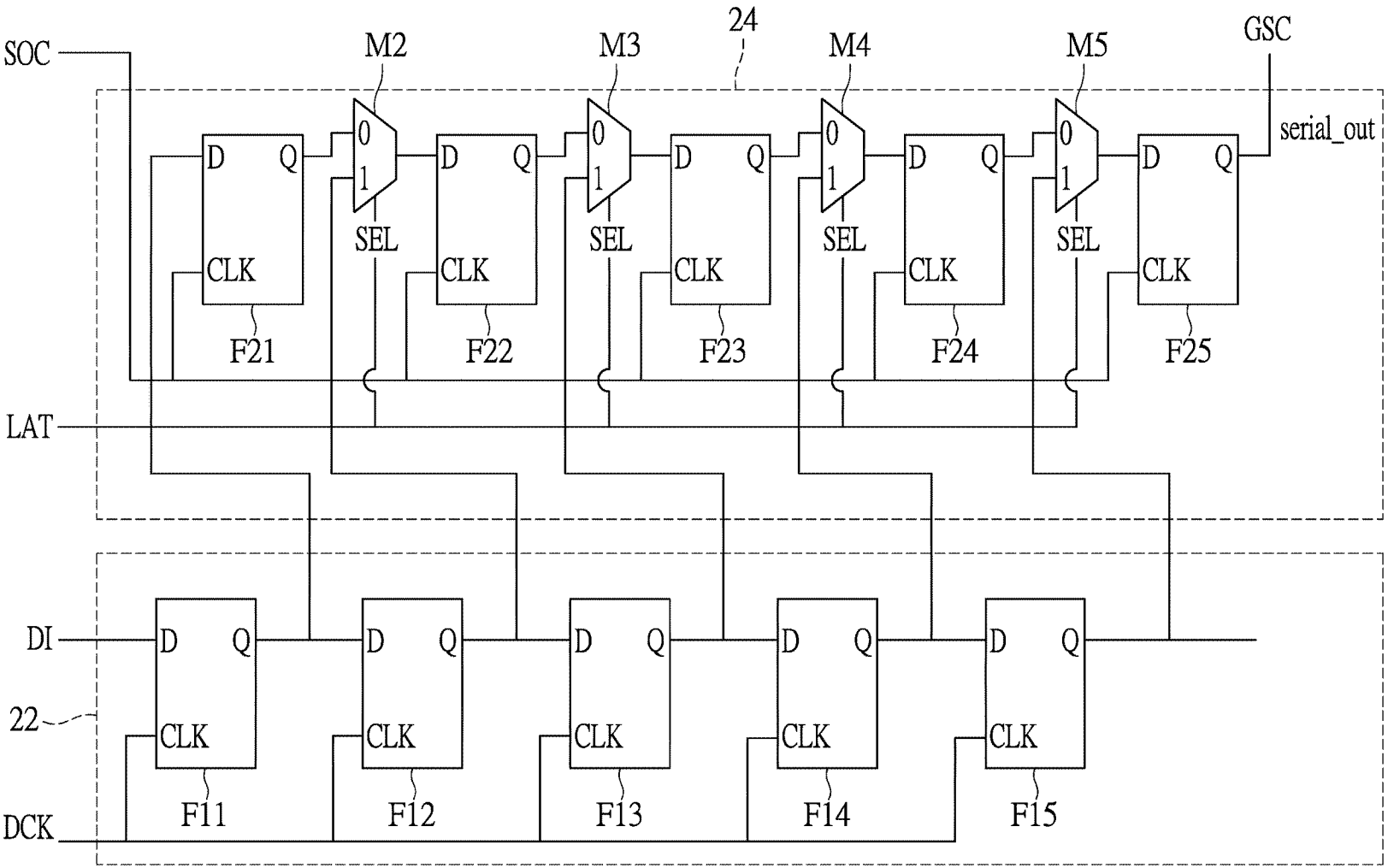
FIG. 3A shows a circuit diagram of a gray scale generation circuit of one embodiment of the present disclosure.
Figure 3B:
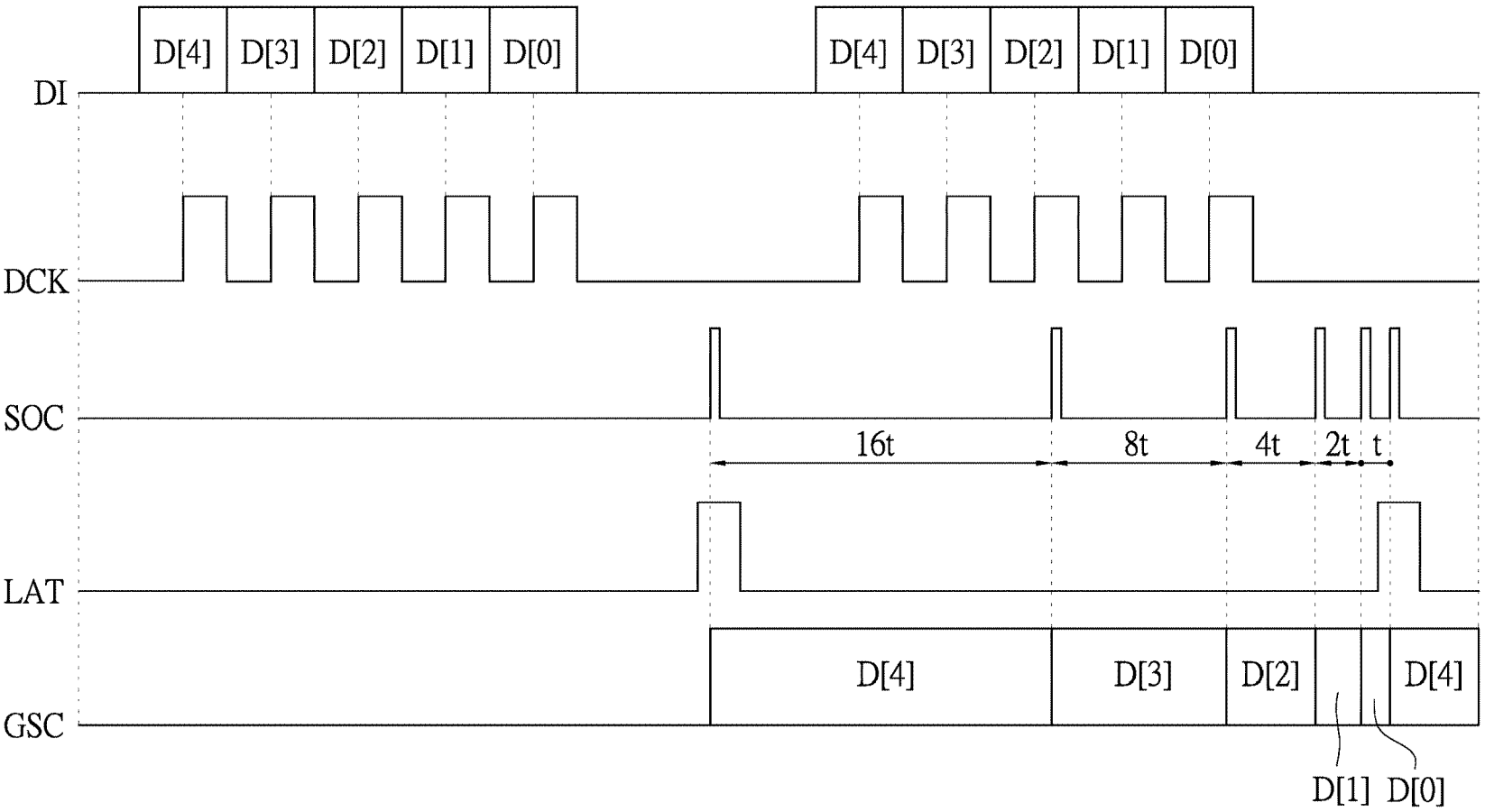
FIG. 3B is a waveform diagram showing how the gray scale generation circuit in FIG. 3A operates.

FIG. 3A shows a circuit diagram of a gray scale generation circuit of one embodiment of the present disclosure, and FIG. 3B is a waveform diagram showing how the gray scale generation circuit in FIG. 3A operates.

For ease of illustration, in this embodiment, n-bit gray-scale data is, for example, a 5-bit gray-scale data (represented by D[4:0]), and in this case, k-bit luminance-related data is the entire gray-scale data (which is, k=n). For example, the 5-bit luminance-related data can be 00000-11111, which is represented by D[4:0].

The circuit configuration and the working principle of the shift register unit 22 of the gray scale generation circuit provided by this embodiment are illustrated as follows. As shown in FIG. 3A, the shift register unit 22 is a shift register. The shift register unit 22 includes a plurality of flip-flops F11~F15, which are rising-edge-triggered. Each of the flip-flops F11~F15 has an input pin D, an output pin Q and a clock pin CLK. The output pin Q of each of the flip-flops F11~F14 is coupled to the input pin D of each of the flip-flops F12~F15. In other words, the output pin Q of the flip-flop F11 is coupled to the input pin D of the flip-flop F12, the output pin Q of the flip-flop F12 is coupled to the input pin D of the flip-flop F13, and so on. The clock pin of each of the flip-flops F11~F15 receives a data clock signal DCK. The input data signal DI with the luminance-related data is received by the input pin D of the flip-flop F11. Then, the luminance-related data is serially inputted to the flip-flops F11~F15 according to the data clock signal DCK. As a result, different bits of the luminance-related data are stored in different flip-flops F111~F15. According to the waveform of the input data signal DI and the data clock signal DCK shown in FIG. 3B, each rising edge of the data clock signal DCK corresponds to one bit of the luminance-related data. In other words, according to the data clock signal DCK, the five bits D[4]~D[0] are sequentially transmitted to the flip-flops F11~F15.

The circuit configuration and the working principle of the data storage unit 24 of the gray scale generation circuit provided by this embodiment are illustrated as follows. In this embodiment, the data storage unit 24 is, for example, a PISO shift register, but it is not limited thereto.

As shown in FIG. 3A, the data storage unit 24 includes a plurality of ring-edge-triggered D-type flip-flops F21~F25 and a plurality of multiplexers M2~M5. Each of the flip-flops F21~F25 has an input pin D, an output pin Q and a clock pin CLK, and each of the multiplexers M2~M5 has a first pin (marked as "0" in FIG. 3A), a second pin (marked as "1" in FIG. 3A), an output pin and a select pin SEL. Between every two flip-flops F21~F25, there is one of the multiplexers M2~M5 configured. For example, the multiplexer M2 is configured between the flip-flop F21 and the flip-flop F22, the multiplexer M3 is configured between the flip-flop F22 and the flip-flop F23, and so on.

In addition, the first pin of each of the multiplexers M2~M5 is coupled to the output pin Q of one adjacent flip-flop F21, F22, F23 or F24. The output pin of each of the multiplexers M2~M5 is coupled to the input pin D of the other adjacent flip-flop F22, F23, F24 or F25. The second pins of the multiplexers M2~M5 are coupled to, respectively, the output pins Q of the flip-flops F12~F15. The select pins SEL of the multiplexers M2~M5 are coupled to a latch signal LAT, and the clock pins of the flip-flops F21~F25 are coupled to a serial-out control signal SOC.

Moreover, the input pin D of the first flip-flop F21 of the data storage unit 24 is coupled to the output pin Q of the first flip-flop F11 of the shift register unit, and a serial signal serial_out is outputted from the output pin Q of the last flip-flop F25 of the data storage unit 24. Then, the gray-scale control signal GSC is generated according to the serial signal serial_out.

Specifically speaking, according to the latch signal LAT received by the select pin of each of the multiplexers M2~M5, the output of each of the multiplexers M2~M5 is dominated by the first pin or the second pin of each of the multiplexers M2~M5. When the latch signal LAT is at high level, the output of each of the multiplexers M2~M5 is dominated by the second pin of each of the multiplexers M2~M5. As a result, the luminance-related data in the shift register unit 22 is transmitted to the flip-flops F21~F25 of the data storage unit 24 at the rising edge of the serial-out control signal SOC. As shown in FIG. 3B, after the luminance-related data is transmitted to the shift register unit 22, the latch signal LAT is set to be "1" before the first rising edge of the serial-out control signal SOC. Then, the luminance-related data in the shift register unit 22 is read by the flip-flops F21~F25 of the data storage unit 24 at the first rising edge of the serial-out control signal SOC. For example, when the flip-flops F11~F15 of the shift register unit 22 store, respectively, the five bits D[0]~D[4] of the luminance-related data, the five bits D[0]~D[4] of the luminance-related data are read respectively by the flip-flops F21~F25 of the data storage unit 24 at the first rising edge of the serial-out control signal SOC.

After that, the latch signal LAT received by the select pin of each of the multiplexers M2~M5 is set to be "0" such that the flip-flops F21~F25 are serially connected. It should be noted that, according to FIG. 3B, the signal can be received at the output end of the gray scale generation circuit (the signal outputted from the output pin of the flip-flop F5) is the fifth bit of the luminance-related data, which is D[4].

It should be noted that, each bit D[0]~D[4] of the luminance-related data corresponds to specific numbers of time units t. In this embodiment, n=5, so the time for emitting light in a frame period can be divided into 31 gray scales or 32 gray scales, and for ease of illustration, the light-emitting time in a frame period can be divided into 31 gray scales. The time length corresponding to each gray scale is defined as one time unit t. For example, the bit D[0] of the luminance-related data corresponds to $2^0$ time units t, the bit D[1] of the luminance-related data corresponds to $2^1$ time units t, the bit D[2] of the luminance-related data corresponds to $2^2$ time units t, the bit D[3] of the luminance-related data corresponds to $2^3$ time units t, and the bit D[4] of the luminance-related data corresponds to $2^4$ time units t.

When the gray-scale data D[4:0] is 10001, the bit D[4] of the luminance-related data is "1" and corresponds to 16 time units t, so the bit received by the driving circuit during these 16 time units is "1". 16 time units t later, the serial-out control signal SOC is transmitted to the clock pin CLK of each of the flip-flops F21~F25 (which is shown by the second rising edge of the serial-out control signal SOC in FIG. 3B) to transmit the bits D[0]~D[3] in the flip-flops F21~F24 respectively to the flip-flops F22~F25. Specifically, the bit D[3] in the flip-flop F24 is transmitted to the flip-flop F25, the bit D[2] in the flip-flop F23 is transmitted to the flip-flop F24, and so on.

When the bit D[3] in the flip-flop F24 is transmitted to the flip-flop F25, the gray-scale control signal GSC generated by the gray scale generation circuit is the fourth bit D[3] of the luminance-related data. The fourth bit D[3] of the luminance-related data is "0" and corresponds to 8 time units t, so the bit received by the driving circuit during these 8 time units is "0". 8 time units t later, the serial-out control signal SOC is transmitted to the clock pin CLK of each of the flip-flops F21~F25 (which is shown by the third rising edge of the serial-out control signal SOC in FIG. 3B) to transmit the bits D[0]~D[2] in the flip-flops F22~F24 respectively to the flip-flops F23~F25. In this manner, the bits D[0]~D[4] of the luminance-related data can be provided at different time points as an entire gray-scale control signal GSC to the driving circuit.

How to make each of the bits D[0]~D[4] of the luminance-related data correspond to a specific number of time units t is illustrated as follows. As shown in FIG. 3B, the time duration from the first rising edge of the serial-out control signal SOC to the second rising edge of the serial-out control signal SOC equals the sum of 16 time units t corresponding to the bit D[4] of the luminance-related data. Thus, the number of time units corresponding to the bit D[4] of the luminance-related data can be set by adjusting the time length between the first rising edge and the second rising edge of the serial-out control signal SOC. Likewise, the number of time units corresponding to the bit D[3] of the luminance-related data can be set by adjusting the time length between the second rising edge and the third rising edge of the serial-out control signal SOC.

In this case, within the time for emitting light of a frame period, the light-emitting of the light emitting unit equals 16 time units t plus 1 time unit t. In other words, the luminance of the light emitting unit is determined by the driving as (16 t+t)/31 t, which is $^{17}/_{31}$.

Speaking of the luminance-related data in a scanning application, a high refresh rate can be achieved by only processing part of bits of the gray-scale data. The luminance will not be influenced as long as each bit of the gray-scale data in the entire frame period corresponds to a proper number of time units. In addition, the bit transmission sequence is not restricted by the bit order. For example, the bit D[4,2,0] can be transmitted before the bit D[3,1,4]. Additionally, the ghost cancellation is usually needed when driving the next scanning line. One way to do the ghost cancellation is to insert a black frame such that the light emitting unit does not emit lights. Inserting a black frame can be done by inserting a dummy bit into the luminance-related data. It indicates that the bit-length of the luminance-related data is not always equal to the bit-length of the gray-scale data. For example, when a dummy bit is inserted into the luminance-related data, the bit-length of the luminance-related data is larger than the bit-length of the gray-scale data.

Figure 3C:
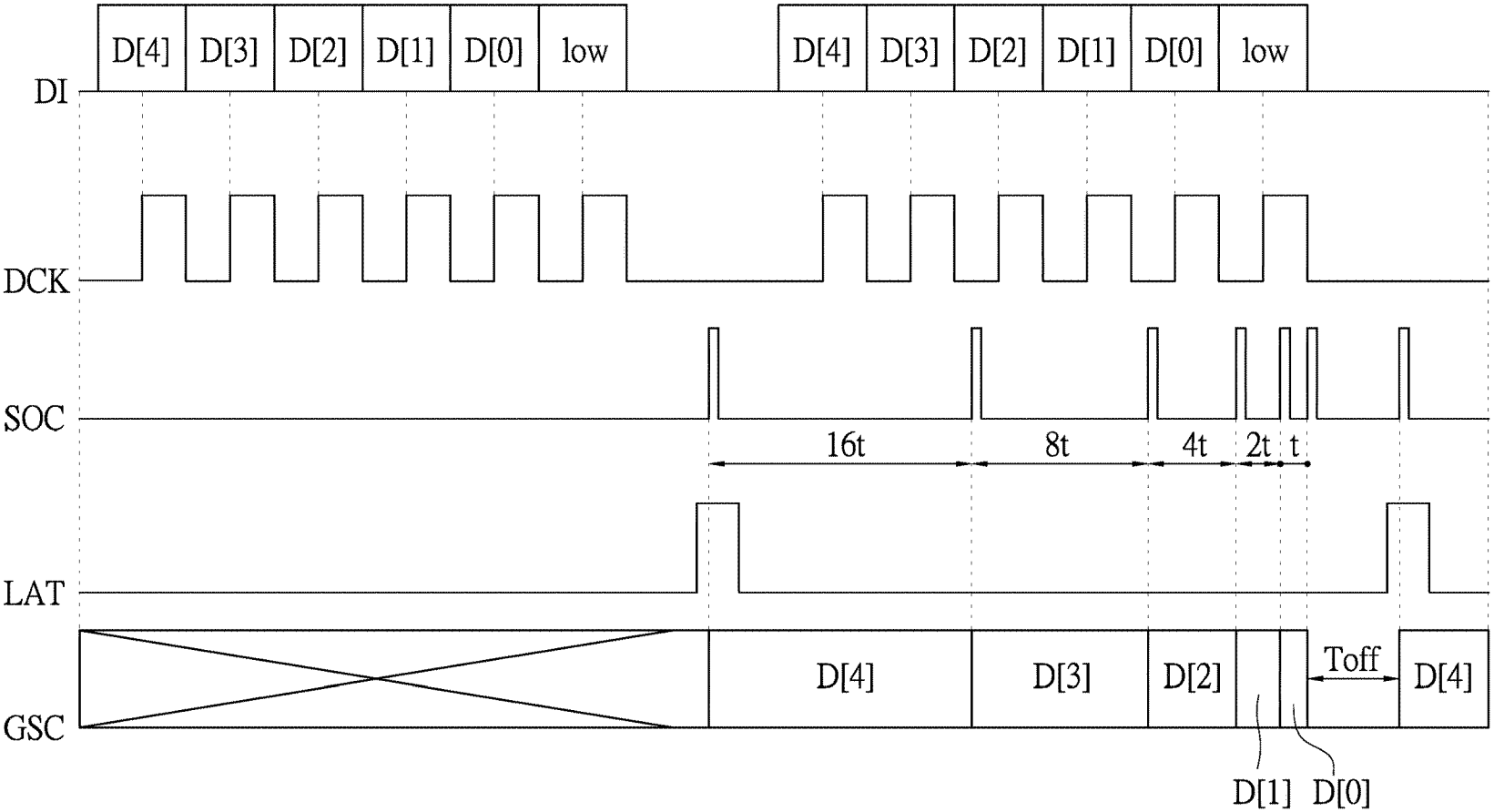
FIG. 3C is a waveform diagram showing how the gray scale generation circuit in FIG. 3A inserts black frames by using dummy bits.

FIG. 3C is a waveform diagram showing how the gray scale generation circuit in FIG. 3A inserts black frames by using dummy bits. As mentioned, inserting a dummy bit "0" into the luminance-related data can implement the black frames insertion (the black frames insertion indicates that a black frame Toff is provided). For example, as shown in FIG. 3C, a dummy bit "0" is inserted after the bit D[0] of the luminance-related data. Thus, the black frame Toff can be set by adjusting the time length between the sixth rising edge and the seventh rising edge of the serial-out control signal SOC.

Figure 3D:
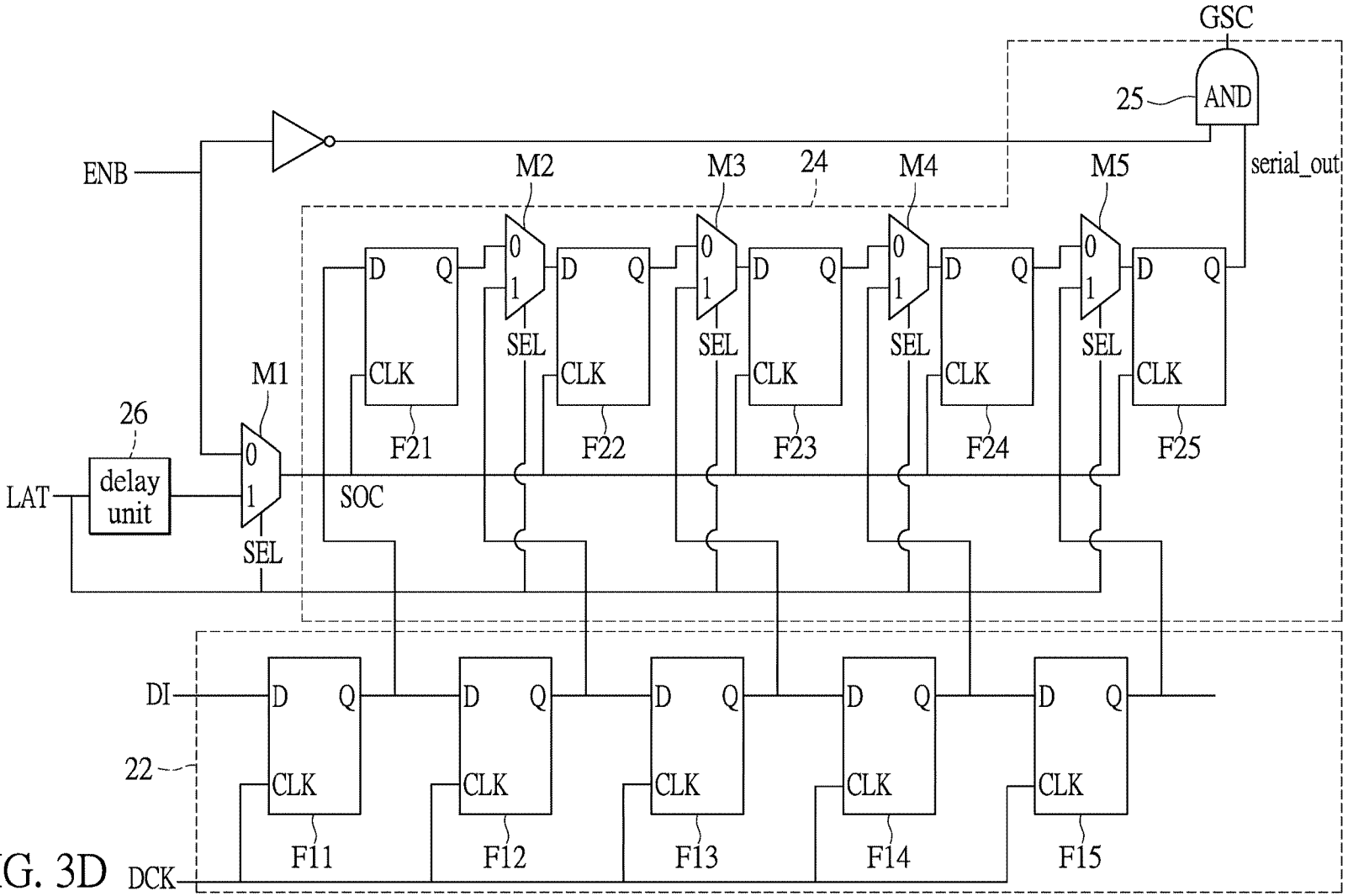
FIG. 3D shows a circuit diagram of a gray scale generation circuit of another embodiment of the present disclosure.
Figure 3E:
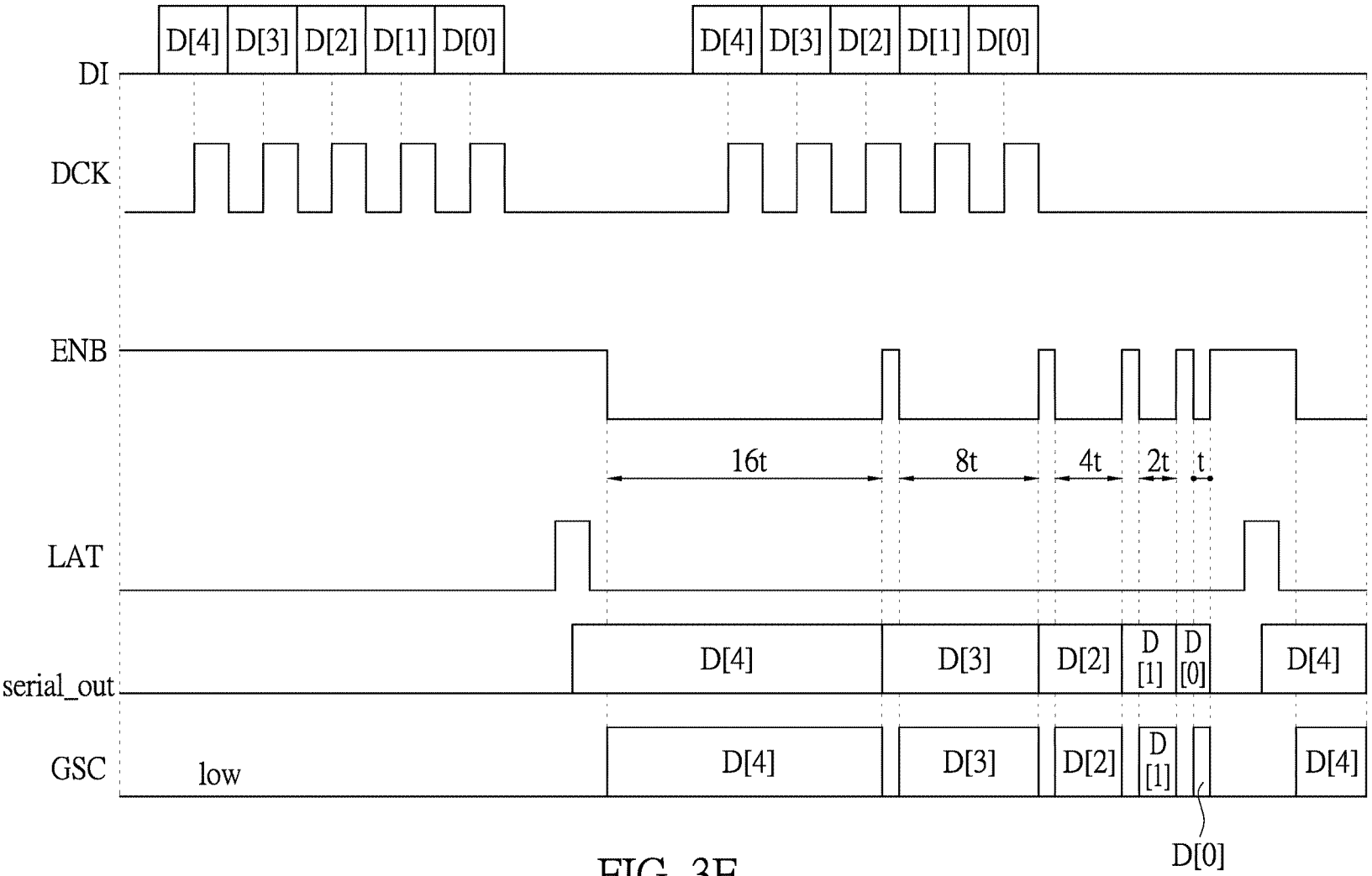
FIG. 3E is a waveform diagram showing how the gray scale generation circuit in FIG. 3D operates.

FIG. 3D shows a circuit diagram of a gray scale generation circuit of another embodiment of the present disclosure. FIG. 3D shows another way to implement the black frames insertion. As shown in FIG. 3D, a logic unit 25 is configured in the data storage unit 24, and the black frames insertion can be implemented by an enable signal ENB. Specifically, the serial-out control signal SOC is generated by combining the latch signal LAT and the enable signal ENB. According to FIG. 3D, through a multiplexer M1 and a delay unit 26, the latch signal LAT and the enable signal ENB are combined as the serial-out control signal SOC. The logic unit 25 is an AND gate AND, one input end of the AND gate AND is coupled to the output end of the flip-flop F25 of the data storage unit 24, and the other input end of the AND gate AND is coupled to the enable signal ENB. In this embodiment, the gray-scale control signal GSC is an output signal outputted by the AND gate AND after the AND gate AND receives an inversed signal EN of the enable signal ENB and the serial signal serial_out outputted from the output end of the flip-flop F25. FIG. 3E is a waveform diagram showing how the gray scale generation circuit in FIG. 3D operates. Differently from FIG. 3B, in FIG. 3E, the number of the time units t corresponding to each of the bits of the luminance-related data is determined by the time point when the enable signal ENB turns to be at low level. As shown in FIG. 3E, the time duration from the first falling edge of the enable signal ENB to the first rising edge of the enable signal ENB equals the sum of 16 time units t corresponding to the bit D[4] of the luminance-related data. Thus, the number of time units corresponding to the bit D[4] of the luminance-related data can be set by adjusting the time length between the first falling edge and the first rising edge of the enable signal ENB. Likewise, the number of time units corresponding to the bit D[3] of the luminance-related data can be set by adjusting the time length between the second falling edge and the second rising edge of the enable signal ENB. In this manner, the serial-out control signal SOC can be generated independently instead of combining the latch signal LAT and the enable signal ENB. In addition, it can be designed that the number of the time units t corresponding to each of the bits of the luminance-related data is determined by the time point when the enable signal ENB turns to be at low level or at high level, and it is not limited thereto.

Another Embodiment of the Gray Scale Generation Circuit

Figure 4A:
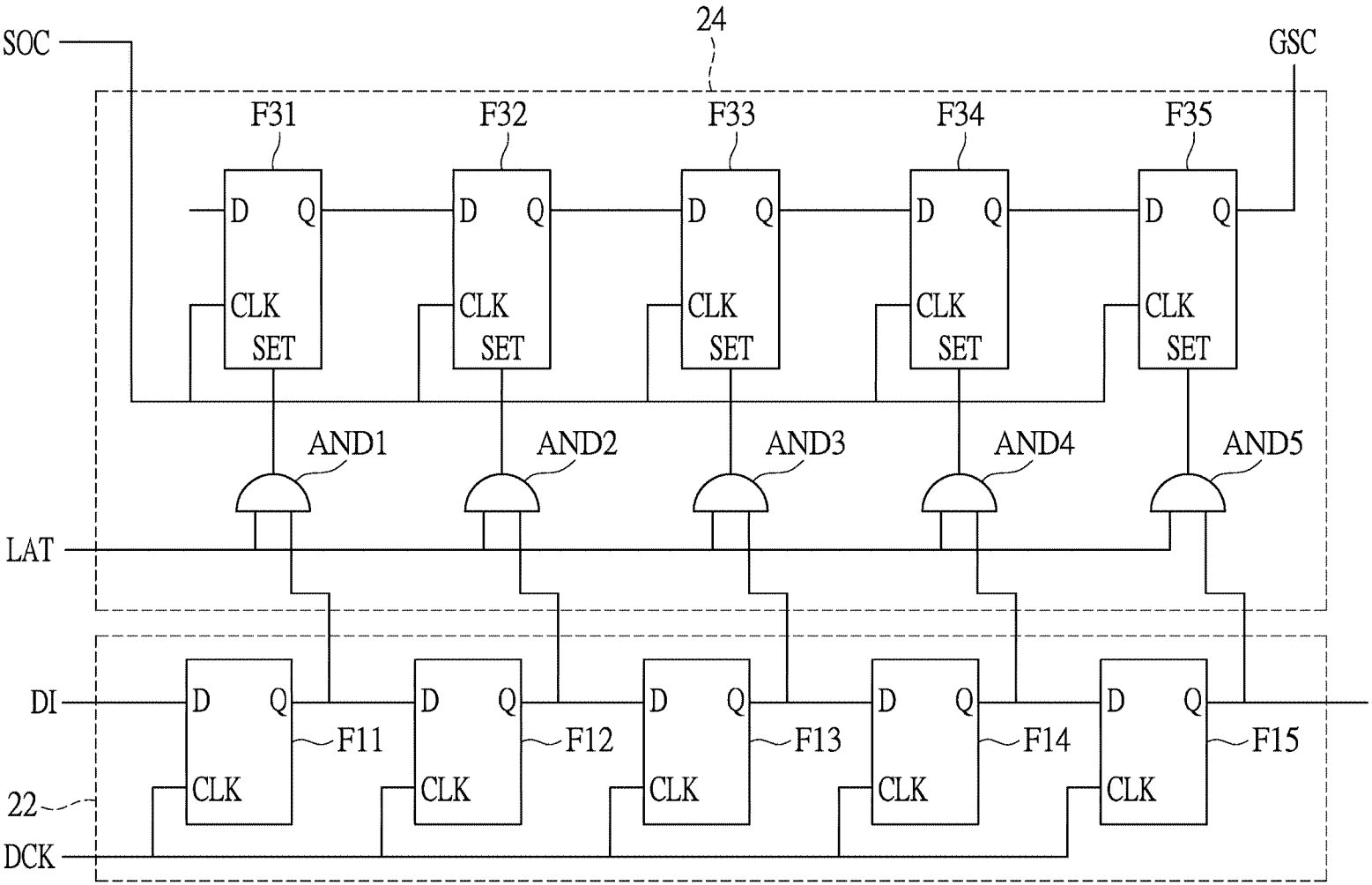
FIG. 4A shows a circuit diagram of a gray scale generation circuit of another embodiment of the present disclosure.
Figure 4B:
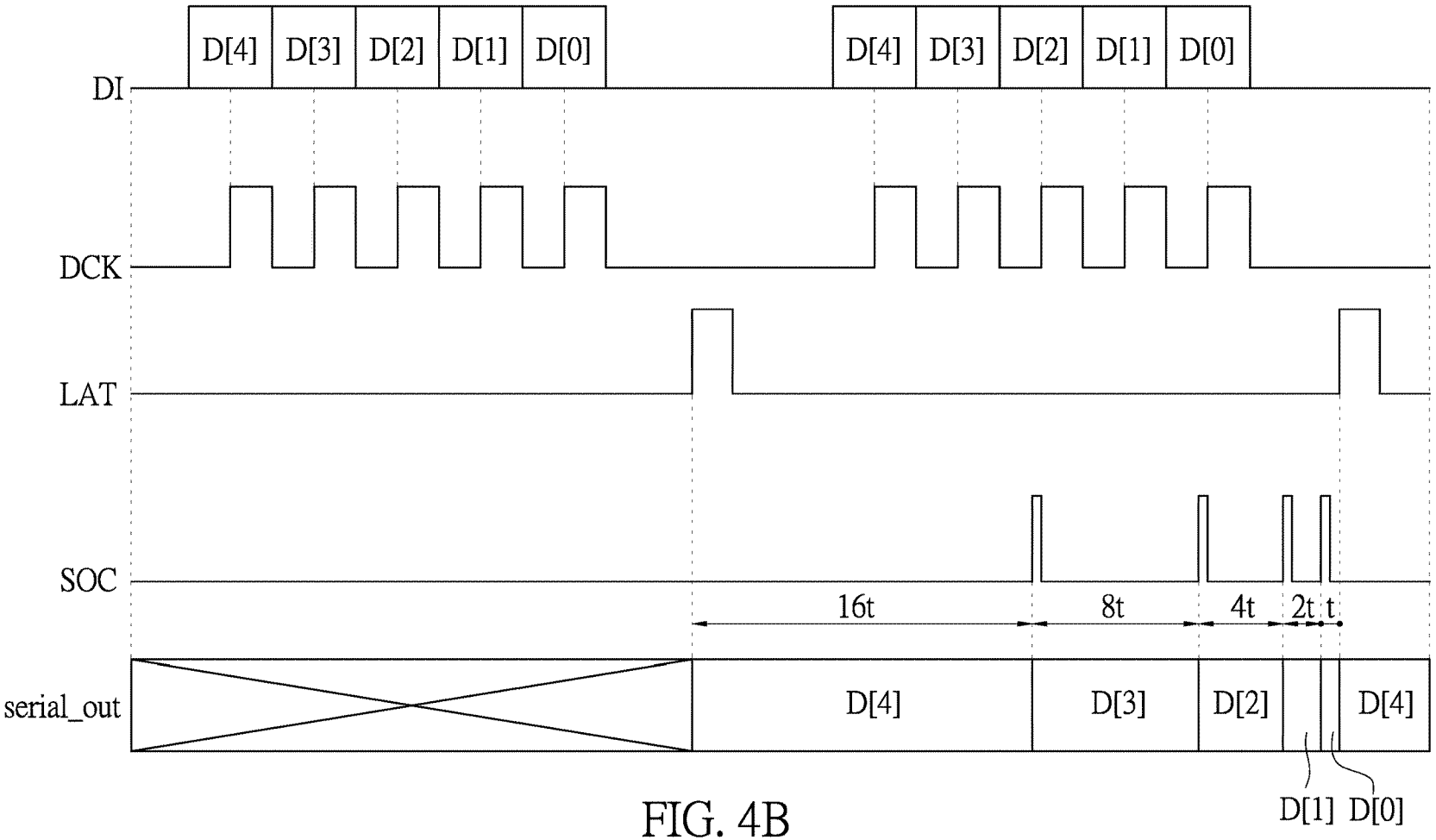
FIG. 4B is a waveform diagram showing how the gray scale generation circuit in FIG. 4A operates.

FIG. 4A shows a circuit diagram of a gray scale generation circuit of another embodiment of the present disclosure, and FIG. 4B is a waveform diagram showing how the gray scale generation circuit in FIG. 4A operates.

For ease of illustration, in this embodiment, n-bit gray-scale data is, for example, a 5-bit gray-scale data (represented by D[4:0]), and in this case, k-bit luminance-related data is the entire gray-scale data (which is, k=n). For example, the 5-bit luminance-related data can be 00000-11111, which is represented by D[4:0].

The shift register unit 22 of the gray scale generation circuit in this embodiment is the shift register unit 22 of the gray scale generation circuit in the previous embodiment. Thus, the circuit configuration and the working principle of the shift register unit 22 of the gray scale generation circuit in this embodiment are not repeatedly described.

The data storage unit 24 of the gray scale generation circuit in this embodiment and the data storage unit 24 of the gray scale generation circuit in the previous embodiment are both parallel in serial out type. However, the data storage unit 24 of the gray scale generation circuit in this embodiment and the data storage unit 24 of the gray scale generation circuit in the previous embodiment have different circuit configurations and working principles. In this embodiment, the data storage unit 24 is, for example, a shift register having reset function.

As shown in FIG. 4A, the data storage unit 24 includes a plurality of ring-edge-triggered D-type flip-flops F31~F35 of which the output signal can be reset as "1" and a plurality of AND gates AND1~AND5. Each of the flip-flops F31~F35 has an input pin D, an output pin Q, a clock pin CLK and a reset pin SET. When a high-level signal is inputted to the reset pin SET of each of the flip-flops F31~F35, the output signal of each of the flip-flops F31~F35 will be reset as "1". The output pins Q of the flip-flops F31~F34 are coupled respectively to the input pins D of flip-flops F32~F35. For example, the output pin Q of the flip-flop F31 is coupled to the input pin D of the flip-flop F32, the output pin Q of the flip-flop F32 is coupled to the input pin D of the flip-flop F33, and so on. Each of the AND gates AND1~AND5 has two input ends and one output end. The output end of each of the AND gates AND1~AND5 is coupled to the reset pin SET of each of the flip-flops F31~F35. One input end of each of the AND gates AND1~AND5 receives a latch signal LAT, and the other input end of each of the AND gates AND1~AND5 is coupled to the output pin Q of each of the flip-flops F11~F15 of the shift register unit 22 to receive each bit of the luminance-related data.

For ease of illustration, the output signal of each of the flip-flops F31~F35 is predetermined as "0" once the gray scale generation circuit is powered up. According to the latch signal LAT and the output signal of each of the flip-flops F31~F35, each of the AND gates AND1~AND5 outputs a signal to the reset pin of each of the flip-flops F31~F35 to make the luminance-related data in the shift register unit transmitted to the flip-flops F31~F35 of the data storage unit 24. It should be noted that, when a low-level signal is inputted to the input pin D of the first flip-flop F31 such that after the data storage unit 24 sequentially outputs each bit of the luminance-related data, the output signal received at the output end Q of each of the flip-flops F31~F35 is set as "0". As shown in FIG. 4B, after the luminance-related data D[4:0] is transmitted to the shift register unit 22, the latch signal LAT is transmitted to each of the AND gates AND1~AND5.

For example, in the shift register unit 22, five bits D[0]~D[4] of the luminance-related data are stored respectively in the flip-flops F11~F15, and the luminance-related data, represented by D[4:0], is 01001. In this case, the bit D[0] of the luminance-related data received by the AND gate AND1 is "1". Thus, after the rising edge of the latching signal LAT, a high-level signal is transmitted from the AND gate AND1 to the reset pin SET of the flip-flop F31 such that the output signal that can be received at the output pin Q of the flip-flop F31 is reset as "1". The bit D[1] of the luminance-related data received by the AND gate AND2 is "0". Thus, after the rising edge of the latching signal LAT, a low-level signal is transmitted from the AND gate AND2 to the reset pin SET of the flip-flop F32 such that the output signal that can be received at the output pin Q of the flip-flop F32 maintains "0". In this case, after the rising edge of the latching signal LAT, a high-level is only outputted from the AND gate AND1 and the AND gate AND4. The output signals that can be received at the output pins Q of the flip-flops F31~F35 are 1, 0, 0, 1, 0, and thus the five bits D[0]~D[4] of the luminance-related data are stored in the flip-flops F31~F35. It is worth mentioning that, the flip-flops F31~F35 of which the output signal can be reset as "0" can also be used to form the data storage unit 24 according to different circuit designs.

It should be noted that, a signal (marked by serial_out in FIG. 4B) is outputted from the output pin Q of the last flip-flop F35 of the data storage unit 24. At the beginning, the gray-scale control signal GSC generated by the gray scale generation circuit is the fifth bit D[4] of the luminance-related data.

Like the above embodiments, in this embodiment, each of the bits D[0]~D[4] corresponds to a specific number of time units t, but the relevant details are not repeatedly described.

When the gray-scale data D[4:0] is 01001, the bit D[4] of the luminance-related data is "0" and corresponds to 16 time units t, so the bit received by the driving circuit during these 16 time units is "0". 16 time units t later, the serial-out control signal SOC is transmitted to the clock pin CLK of each of the flip-flops F31~F35 (which is shown by the first rising edge of the serial-out control signal SOC in FIG. 3B) to transmit the bits D[0]~D[3] in the flip-flops F31~F34 respectively to the flip-flops F32~F35. Specifically, the bit D[3] in the flip-flop F34 is transmitted to the flip-flop F35, the bit D[2] in the flip-flop F33 is transmitted to the flip-flop F34, and so on.

After the first rising edge of the serial-out control signal SOC, the gray-scale control signal GSC outputted by the gray scale generation circuit is the fourth bit D[3] of the luminance-related data. The fourth bit D[3] of the luminance-related data is "1" and corresponds to 8 time units t, so the bit received by the driving circuit during these 8 time units is "1". 8 time units t later, the serial-out control signal SOC is transmitted to the clock pin CLK of each of the flip-flops F31~F35 (which is shown by the second rising edge of the serial-out control signal SOC in FIG. 4B) to transmit the bits D[O]~D[2] in the flip-flops F32~F34 respectively to the flip-flops F33~F35.

It should be noted that, when the bits D[O]~D[3] in the flip-flops F31~F34 are transmitted respectively to the flip-flops F32~F35, a low-level signal is inputted to the input pin D of the first flip-flop F31 to set the output signal outputted from the output pin Q of the first flip-flop F31 as "0", and when the bits D[0]~D[2] in the flip-flops F32~F34 are transmitted respectively to the flip-flops F33~F35, the output signal outputted from the output pin Q of the first flip-flop F31, which is "0", makes the output signal outputted from the output pin Q of the first flip-flop F32 set as "0". In this manner, after the luminance-related data is entirely outputted, the output signal that can be received at the output pin Q of each of the flip-flops F31~F35 are set as "0".

How to make each of the bits D[0]~D[4] of the luminance-related data correspond to a specific number of time units t is illustrated as follows. As shown in FIG. 4B, the time duration from the first rising edge of the latch signal LAT to the first rising edge of the serial-out control signal SOC equals the sum of 16 time units t corresponding to the bit D[4] of the luminance-related data. Thus, the number of time units corresponding to the bit D[4] of the luminance-related data can be set by adjusting the time length between the first rising edge of the latch signal LAT and the first rising edge of the serial-out control signal SOC. Likewise, the number of time units corresponding to the bit D[3] of the luminance-related data can be set by adjusting the time length between the first rising edge and the second rising edge of the serial-out control signal SOC.

In this case, within the time for emitting light of a frame period, the light-emitting of the light emitting unit equals 8 time units t plus 1 time unit t. In other words, the luminance of the light emitting unit is determined by the driving as (8 t+t)/31 t, which is $9/31$.

In this embodiment, the black frame insertion can also be implemented by inserting a dummy bit into the luminance-related data or by using a logic unit and providing an enable signal ENB; however, the relevant details are not repeatedly describe herein.

One Embodiment of the Driving Circuit

Figure 5:
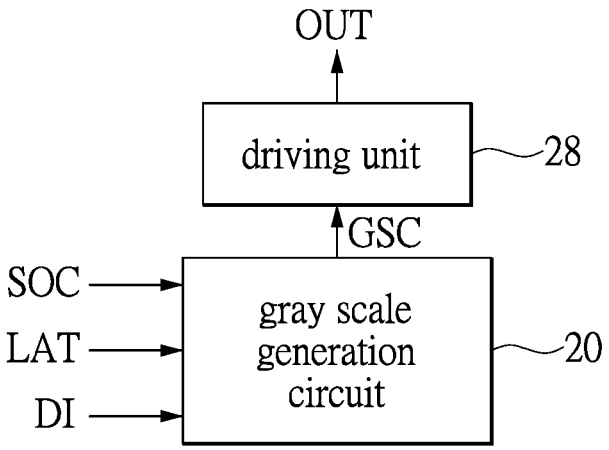
FIG. 5 shows a block diagram of a driving circuit of one embodiment of the present disclosure.

Referring to FIG. 5, a block diagram of a driving circuit of one embodiment of the present disclosure is shown. The driving circuit provided by this embodiment is for determining the light-emitting time of a light emitting unit and driving the light emitting unit to emit lights. For example, the light emitting unit can be used in a displayer, but it is not limited thereto.

As shown in FIG. 5, the driving circuit includes a gray scale generation circuit 20 and a driving unit 28. The driving unit 28 has an input end and an output end, and the input end of the driving unit 28 is coupled to the gray scale generation circuit 20. The driving unit 28 determines the on time of a driving signal OUT outputted from the output end of the driving unit 28 according to the gray-scale control signal GSC generated by the gray scale generation circuit 20. It should be noted that, the electrical property of the driving signal OUT is determined by properties of the light emitting unit. For example, the driving unit 28 can output a predetermined voltage or a predetermined current during its on time. It should be also noted that, in the driving circuit provided by this embodiment, the gray scale generation circuit 20 can be implemented by any gray scale generation circuit provided in the above embodiments.

To sum up, in the present disclosure, each bit of the luminance-related data corresponds to a specific number of time units. In addition, a PISO data storage unit replaces the data storage unit, the gray-scale counter and the digital comparator in a conventional gray scale generation circuit. Therefore, the gray scale generation circuit of the present disclosure has all bits of the data inputted at the same time but outputs different bits of the data at different time points. Then, the driving circuit of the present disclosure determines the light-emitting time/the luminance of the light emitting unit according to different bits and their corresponding numbers of time units.

Due to the above working mechanism, the present disclosure has at least two advantages. First, the gray scale generation circuit of the present disclosure can adjust the number of time units corresponding to each bit of the luminance-related data. Thus, it is easy to divide the time for emitting light of one frame period into more time units. In addition, by replacing the data storage unit, the gray-scale counter and the digital comparator in a conventional gray scale generation circuit with a PISO data storage unit, the circuit cost can be effectively reduced. Accordingly, the gray scale generation circuit and the driving circuit using the same can support high bit data but will not raise the circuit cost.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A driving circuit, used for driving a light emitting unit, comprising:

a gray scale generation circuit, including:

a shift register unit, receiving a luminance-related data, wherein the shift register unit is a k-bit shift register unit and k is a positive integer greater than 1; and a data storage unit, having a plurality of parallel input ends and a serial output end, the data storage unit receiving a plurality of bits of the luminance-related data via its parallel input ends from the shift register unit and serially outputting the bits to generate a serial signal, and the data storage unit generating a gray-scale control signal according to the serial signal, wherein the data storage unit determines time points for outputting different bits of the serial signal according to a serial-out control signal; and a driving unit, coupled to the gray scale generation circuit, adjusting a light-emitting time of the light emitting unit according to the gray-scale control signal received from the gray scale generation circuit.

2. The driving circuit according to claim 1, wherein different bits of the luminance-related data correspond to different numbers of time units, and the gray scale generation circuit generates the gray-scale control signal according to different bits of the luminance-related data and their corresponding numbers of time units.

3. The driving circuit according to claim 1, wherein the shift register unit is a shift register.

4. The driving circuit according to claim 1, wherein the data storage unit is a PISO shift register, the PISO shift register is coupled to a latch signal, and according to the latch signal and the serial-out control signal, the luminance-related data in the shift register unit is transmitted to the PISO shift register or the bits in the PISO shift register are serially outputted as the serial signal.

5. The driving circuit according to claim 4, wherein the PISO shift register includes:

a plurality of flip-flops, each flip-flop having an input pin, an output pin and a clock pin; and a plurality of multiplexers, each multiplexer having a first pin, a second pin, an output pin and a select pin, wherein the multiplexers are configured respectively between every two flip-flops, the first pin of each multiplexer is coupled to the output pin of the adjacent flip-flop, the output pin of each multiplexer is coupled to the input pin of the other adjacent flip-flop, the second pin of each multiplexer is coupled to the shift register unit, and the select pins of each multiplexer is coupled to the latch signal.

6. The driving circuit according to claim 5, wherein in the PISO shift register, the clock pin of each flip-flop is coupled to the serial-out control signal, and the serial signal is outputted from the output pin of the last flip-flop.

7. The driving circuit according to claim 4, wherein the PISO shift register includes:

a plurality of flip-flops, each flip-flop having an input pin, an output pin, a clock pin and a reset pin, wherein the flips-flops forms a shift register; and a plurality of logic gates, each logic gate having two input ends and an output end, wherein the output end of each logic gate is coupled to the reset pin of each flip-flop, an input end of the logic gate is coupled to the latch signal, and the other input end of the logic gate is coupled to the shift register unit to receive each bit in the shift register unit;

wherein each logic gate outputs a signal to the reset pin of its corresponding flip-flop according to each bit in the shift register unit and the latch signal, to transmit each bit in the shift register unit to the PISO shift register.

8. The driving circuit according to claim 7, wherein in the PISO shift register, the clock pin of each flip-flop is coupled to the serial-out control signal, the input pin of the first flip-flop receives a low-level signal, and the output pin of the last flip-flop outputs the serial signal.

9. The driving circuit according to claim 4, wherein the data storage unit includes a logic unit, the logic unit has two input ends and an output end, one input end of the logic unit is coupled to the serial signal, and the other input end of the logic unit is coupled to an enable signal, wherein the logic unit generates the gray-scale control signal according to the serial signal and the enable signal.

10. The driving circuit according to claim 9, wherein the serial-out control signal is generated according to the enable signal and the latch signal.

11. A gray scale generation circuit, comprising:

a shift register unit, receiving a luminance-related data, wherein the shift register unit is a k-bit shift register unit and k is an positive integer greater than 1; and a data storage unit, having a plurality of parallel input ends and a serial output end, the data storage unit receiving a plurality of bit of the luminance-related data via its parallel input ends from the shift register unit and serially outputting the bit to generate a serial signal, and the data storage unit generating a gray-scale control signal according to the serial signal;

wherein the data storage unit determines different time points of outputting different bits of the serial signal according to a serial-out control signal.

12. The gray scale generation circuit according to claim 11, wherein different bits of the luminance-related data correspond to different numbers of time units, and the gray scale generation circuit generates the gray-scale control signal according to different bits of the luminance-related data and their corresponding numbers of time units.

13. The gray scale generation circuit according to claim 11, wherein the data storage unit is a PISO shift register, the PISO shift register is coupled to a latch signal, and according to the latch signal and the serial-out control signal, the luminance-related data in the shift register unit is transmitted to the PISO shift register or the bits in the PISO shift register are serially outputted as the serial signal.

14. The gray scale generation circuit according to claim 13, wherein the data storage unit includes a logic unit, the logic unit has two input ends and an output end, one input end of the logic unit is coupled to the serial signal, and the other input end of the logic unit is coupled to an enable signal, wherein the logic unit generates the gray-scale control signal according to the serial signal and the enable signal.

15. The gray scale generation circuit according to claim 14, wherein the serial-out control signal is generated according to the enable signal and the latch signal.

* * * * *